US006203163B1

(12) United States Patent
Conway, Jr.

(10) Patent No.: US 6,203,163 B1
(45) Date of Patent: Mar. 20, 2001

(54) AIR PUMP MOISTURE DAMAGE PROTECTION SYSTEM FOR AN ARTICLE DISPLAY CASE

(76) Inventor: William F. Conway, Jr., 709 Victoria Ct., New Albany, IN (US) 47150

( * ) Notice: Subject to any disclaimer, the term of this patent is extended or adjusted under 35 U.S.C. 154(b) by 0 days.

(21) Appl. No.: 09/388,120

(22) Filed: Sep. 1, 1999

(51) Int. Cl.[7] ..... F21V 33/00

(52) U.S. Cl. ..... 362/96; 362/101; 362/811; 40/406

(58) Field of Search ..... 362/96, 101, 253, 362/318, 562, 806, 811; 446/153; 119/254, 266, 267; 40/406

(56) References Cited

U.S. PATENT DOCUMENTS

| | | | | |
|---|---|---|---|---|
| 3,292,579 | * | 12/1966 | Buchanan | 40/406 |
| 3,773,015 | * | 11/1973 | Cruickshank et al. | 119/254 |
| 4,923,429 | * | 5/1990 | Lewis | 40/406 |
| 5,967,639 | * | 10/1999 | Shih | 362/101 |

OTHER PUBLICATIONS

Copy of page from advertising publication entitled Bubble Lamps® by Mirroteck International LLC. The advertising publication was in circulation more than one year before the filing date of the above–identified application, and The product shown in the publication under Model No. LBB60SF was in public use and on sale in the United States more than one year prior to the filing date of said publication. A complete description of this product is disclosed in the Background of the Invention portion of said application.

* cited by examiner

*Primary Examiner*—Alan Cariaso
(74) *Attorney, Agent, or Firm*—Maurice L. Miller, Jr.

(57) ABSTRACT

A moisture damage protection system for an article display case of the type which uses an air pump to inject high pressure air through an air line into a base portion of a transparent, liquid filled tube or column to form bubbles which rise through the liquid in the column is disclosed. The protection system prevents liquid in the column from backing up through the air line into the air pump when the pump is de-energized. A hollow pipe, which may be in the form of one of several support pipes for article support plates surrounding the column, is provided in which the air line from an air outlet port of the pump is inserted. The air line extends upwardly through the hollow pipe to a level above the level of the liquid in the tube, then loops back downwardly through the hollow pipe and out of a base portion of the hollow pipe into an air inlet port in a base portion of the column which is in communication with the liquid in the column. When the pump is de-energized, liquid from the column can not back-up into the air line far enough upwardly through the hollow pipe to reach the loop at the upper end of the air line, whereby liquid from the column can not back-up into the pump when it is de-energized.

12 Claims, 2 Drawing Sheets

AIR PUMP MOISTURE DAMAGE PROTECTION SYSTEM FOR AN ARTICLE DISPLAY CASE

BACKGROUND OF THE INVENTION

This invention relates to an arrangement for protecting an air pump used to generate air bubbles in a central liquid filled tube of an article display case from damage caused by the back-up of liquid from the tube into the pump when the pump is in a de-energized condition.

Broadly speaking, article display cases having an elongated, vertically extending, transparent, central tube filled with a liquid such as water in which air bubbles can be generated by means of a conventional high pressure air pump are old and well known in the art. Typically, such a central tube is mounted on the face of an electric lamp and the lamp is energized simultaneously with the air pump so that air bubbles formed in the liquid in a lower end of the tube will be illuminated as they rise through the tube. An upper end of the tube is capped or otherwise enclosed but contains perforations therein through which the air bubbles can escape the liquid to ambient atmosphere, they being continuously replaced in the liquid by the air pump at the base of the tube.

Typically, a cone shaped cover surrounds a base portion of the tube and conceals the pump, an air line from the pump to a base portion of the tube, the lamp and other components of the bubble forming and illuminating system from view. Usually, a number of vertically spaced apart, clear plastic, article support plates are glued to and around the central tube. A colored lens may be used over the face of the lamp to cause a colored light beam to illuminate the bubbles in the tube in like color, thus making an attractive and eye catching display for candy and/or other articles placed for public exhibition on the support plates. An example of such a prior art display case is sold by Mirrotek International LLC., 90 Dayton Avenue, Passiac, N.J., 07055, under the registered trademark BUBBLE LAMPS as model No. LBB60SF.

One difficulty which has been encountered when using such prior art display cases is that liquid in the central tube has a tendency to back-up through the air line and severely damage, if not destroy, the air pump upon deactivation of the pump and expulsion of high pressure air from the air line. To overcome this problem in the prior art, a one way check valve has been placed in the air line between the pump and the tube which allows high pressure air to flow from the pump into the tube but which closes upon de-energizing the pump to prevent liquid from the tube from backing up through the air line past the check valve into the pump. The problem is that such check valves have a very short service life span as compared to the service life span of the usual air pump. Accordingly, such check valves eventually fail, usually sooner, rather than later, resulting in the loss of a relatively expensive air pump to moisture damage long prior to the end of its normally expected service life span.

To extend the effective life of the pump in such display cases, resort has been had to the placement of two or three such check valves in series in the air line between the pump and the tube, the theory being that if one such valve fails, the other one or two will continue to operate to protect the pump. Eventually, however, and usually long prior to the end of the useful service life of the pump under normal circumstances, all of the check valves in the series combination will fail resulting in moisture damage to the pump.

Another difficulty I have noticed with these prior art central tube display cases is that, because of their length, which is typically about five feet in height, they tend to be somewhat rickety, unstable and tiltable on their bases, sometimes to the point of actually toppling over, thus spilling articles from the plates and losing liquid from the upper end of the tube through the perforations therein. This is a particular problem where the display case is located in high traffic areas such as in busy retail stores and the like.

By means of my invention, these and other difficulties encountered using prior art display cases of the aforementioned type are substantially eliminated.

SUMMARY OF THE INVENTION

It is an object of my invention to provide an improved article display case of the type which conventionally uses an air pump to form air bubbles in a base portion of an elongated, transparent, liquid filled, central tube which extends vertically through a series of vertically spaced apart article support plates.

It is a further object of my invention to protect the air pump used in such an article display case from damage due to the back-up of liquid from a base portion of the tube through a pump air line into the pump itself, which can otherwise occur when the pump is de-energized.

It is also an object of my invention to provide an air pump moisture damage protection system for such a display case which does not require the use of one or more check valves disposed in the air line between the air pump and the tube.

In accordance with these objects, I provide an article display case of the type which conventionally includes a base, a series of vertically spaced apart article support plates disposed in registry over the base, and an elongated, transparent, hollow, liquid containing tube which extends vertically upwardly from the base through the plates. The display case also conventionally includes an air pump mounted on the base which contains an air outlet port for connection to a base portion of the tube to pump air, under pressure, into the liquid contained in the tube to form air bubbles therein. An upper end of the tube communicates with atmosphere to disperse the bubbles from the liquid. In combination with the foregoing, I provide an arrangement for protecting the air pump from damage due to a back-up of the liquid into the pump when the pump is inactive. The arrangement comprises a hollow pipe disposed on one end thereof on the base and extending vertically upwardly parallel to and spaced apart from the tube beside the plates. The arrangement also comprises an air line connected on one end to the air outlet port and extending into a hollow shaft in a lower end portion of the pipe, thence upwardly through the shaft to a level above the surface of the liquid in the tube, thence back downwardly through the shaft to a base portion of the pipe and, finally, out of said pipe to an air inlet port on a base portion of the tube which communicates with the liquid.

These and other objects, features and advantages of my invention will become apparent to those skilled in the art from the following detailed description and attached drawings on which, by way of example, only a preferred embodiment of my invention is described and illustrated.

DESCRIPTION OF THE PREFERRED EMBODIMENT

Figures 1, 1A:
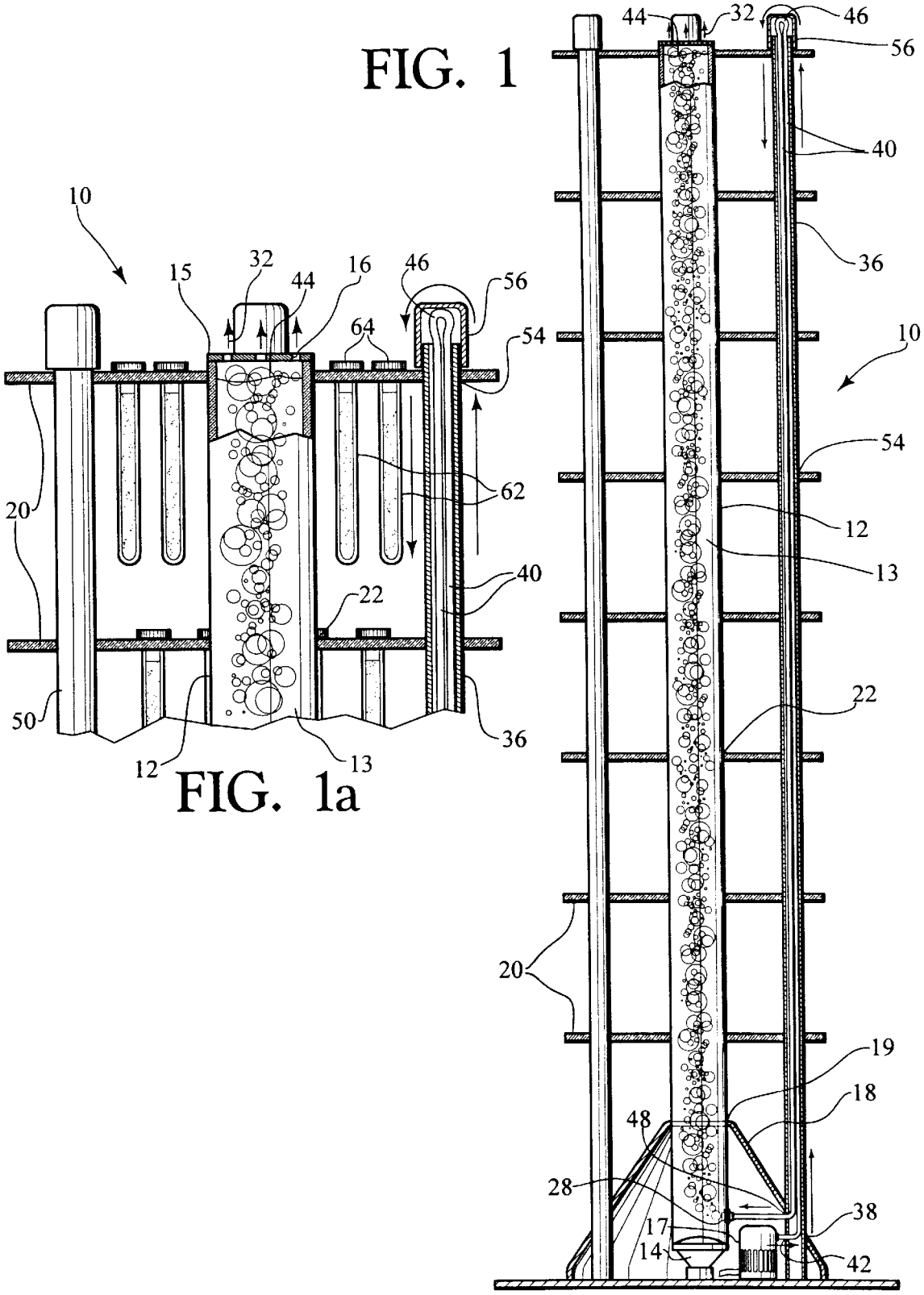
FIG. 1 shows a partially cross-sectioned elevation view of an improved article display case having a conventional transparent, illuminated, liquid filled central tube or column through which air bubbles rise from a base portion fed by an air pump, the display case featuring a novel arrangement for protecting the pump from damage due to liquid backup, thus illustrating a preferred embodiment of my invention.
FIG. 1*a* shows an enlarged detail view of an upper end portion of the display case of FIG. 1, the same as viewed in the latter mentioned figure.
Figure 2:
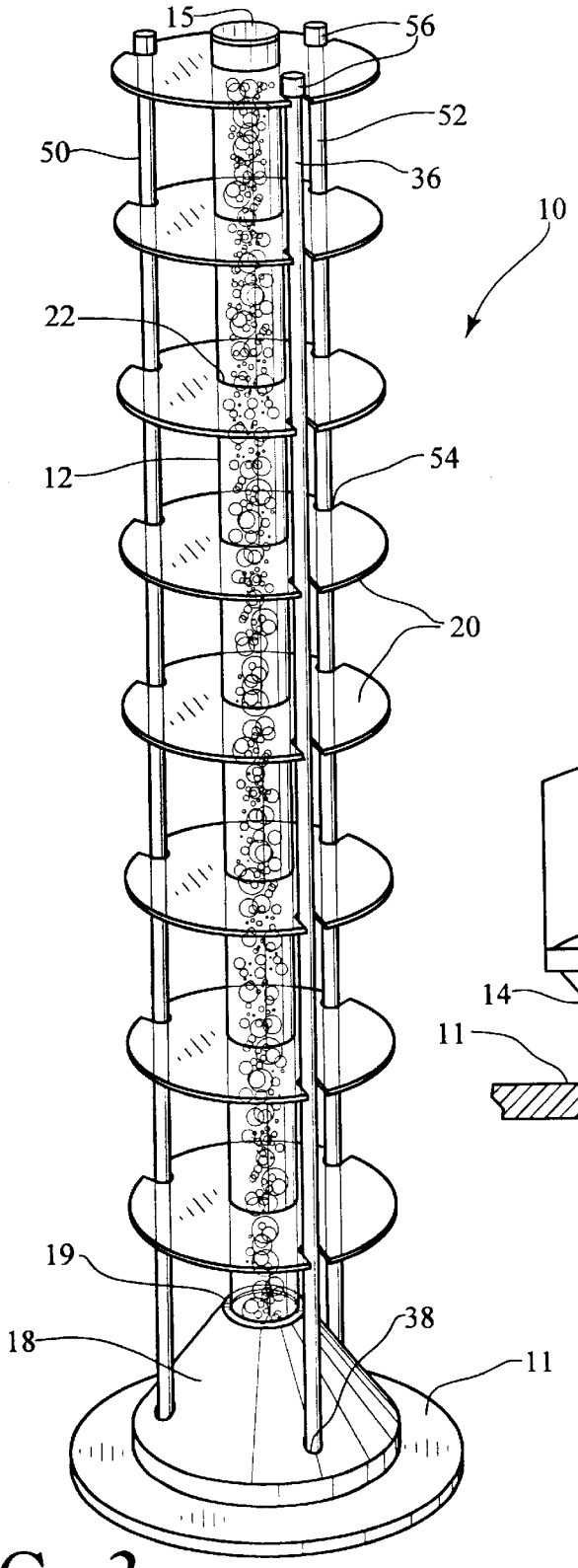
FIG. 2 shows a perspective view of the display case of FIGS. 1 and 1*a* wherein the arrangement for protecting the pump is advantageously concealed from view.

Referring now to the drawing figures and, in particular, to FIGS. 1, 1*a* and 2, there is shown, in a preferred embodiment of my invention, an improved multi-tier article display case, generally designated 10. The prior art structure of the display case 10 includes a base 11, and an elongated, vertically extending, hollow tube 12 constructed of a suitable transparent material such as plastic. A lower end of the tube 12 is conventionally mounted over the face of an upwardly directed electric lamp 14 disposed on the base 11, the tube being filled with a liquid 13 such as water to a level near an upper end 15 thereof and the upper end, which is enclosed or capped, contains perforations 16 (See FIG. 1*a*). The prior art structure also includes an electrically operated air pump 17 (See FIG. 1) mounted on the base 11 and a circular cone shaped cover 18 which rests on the base and defines a central circular opening 19 in a truncated upper portion thereof through which a base portion of the tube 12 extends. The cover 18 thus conceals the lamp 14, air pump 17 and associated air lines as indicated by comparing FIG. 1 with FIG. 2. The prior art structure also includes a series of vertically spaced apart article support plates 20 which are preferably constructed of a transparent plastic, each of which plates define a circular central opening 22 through which the tube 12 extends. Conventionally, the plates 20 are relatively thin and flexible so that each can be flexed and slid along the tube 12 to a desired position. A like series of plastic collars are slid along the tube 12 to form a base under each of the plates 20. The collars and plates are then glued to the tube 12 to secure them permanently in place. While the plates 20 are preferably in the form of circular discs as shown, they may be oval, rectangular or of any other suitable geometric configuration as desired.

Figure 3:
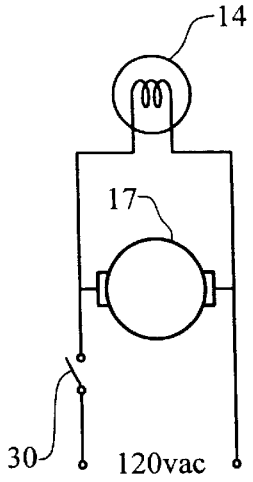
FIG. 3 shows an electrical wiring diagram for the air pump and illumination means of the display case of FIG. 1.
Figure 4:
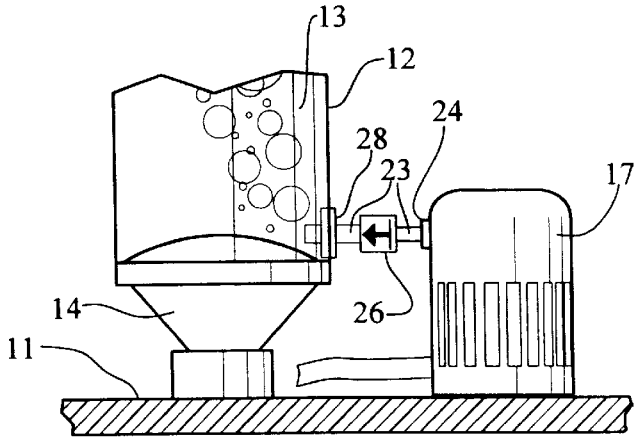
FIG. 4 (PRIOR ART)
FIG. 4 shows an elevation view of a base portion of a display case similar in outward appearance to the display case of FIG. 1 with a pump cover removed to show a prior art arrangement for protecting an air pump used to produce bubbles in a transparent, illuminated, liquid filled central column.

In the conventional form as previously explained and with reference now also to FIG. 4, the air pump 17 is typically connected through an air line 23 from a high pressure air outlet port 24, through one or more conventional one-way check valves 26 as shown schematically, directly to an air inlet port 28 located on a lower end portion of the tube 12 beneath the cover 18, which inlet port is in communication with the liquid 13 in the tube 12. When energized, as by means of an electrical switch 30 (See FIG. 3), high pressure air is introduced from the pump 17, through the check valve or valves 26 into the base of the tube 12 where it bubbles upwardly through the liquid 13. The switch 30 also simultaneously energizes the lamp 14 to shine upwardly through the liquid 13 to illuminate the air bubbles as they rise through the tube 12. The illuminated air bubbles are thereafter vented to atmosphere through the perforations 16 in the upper end or cap 15 of the tube 12 as indicated by arrows 32 in FIGS. 1 and 1*a*.

The check valve or valves 26 are intended to prevent the liquid 13 in the tube 12 from backing up through the air line 23 into the air pump 17 when the latter is de-energized, an event that can seriously damage or ruin the pump. Because a single check valve has a relatively short service life span, as compared to the normal life span of the pump 17, typically two or even three such check valves are used in series as at 26 in FIG. 4 to extend the useful life of the pump. Ultimately, however, the result is the same in that, at some point, all of the check valves used at 26 will fail, resulting in water damage to the pump 17, necessitating replacement thereof at considerable expense, and leakage of liquid 13 from the tube 12 through the pump 17 to the surrounding floor, often resulting in damage to carpet and necessitating substantial clean-up.

To remedy this problem with the prior art structure, I have added an elongated, vertically extending hollow pipe 36, as shown in FIGS. 1 and 1*a*, which is mounted on its lower end on the base 11 and which extends upwardly from the base through an opening 38 in the cover 18 beside each of the plates 20. As shown in FIG. 1, an air line 40 is connected, on one end, to the outlet port 24 of the pump 17 and extends through an opening 42 formed in a lower end portion of the pipe 36 beneath the cover 18, thence upwardly through a hollow shaft in the pipe to a level above a surface 44 of the liquid 13 in the tube 12, thence in a loop 46 at the upper end of the pipe and back downwardly through the pipe and through an opening 48 in the pipe under the cover 18 to the air inlet port 28 on the tube. In this arrangement, when the pump 17 is de-energized and high pressure air is vented from the air line 40 into the liquid 13, a portion of the liquid 13 in the tube 12 will back-up through the air inlet port 28 into the air line 40 and will rise in the air line only to a level equal to the then existing level 44 of liquid 13 remaining in the tube. But since the air line 40 extends to a height above the level 44 of the liquid 13 in the tube 12, the liquid will not have occasion to back-up over and around the loop 46 so as to enter the pump 17 when the latter is in a de-energized state. By virtue of this arrangement of the air line 40, the pump 17 is protected from damage due to liquid back-up from the tube 12 when the pump is de-energized and there is no longer a need to employ one or more check valve(s) 26 in the air line.

Moreover, the hollow pipe 36, which is preferably opaque and made of a suitable material such as plastic or metal, conceals the portion of the air line 40 which extends therethrough above the cover 18. Finally, in the preferred embodiment, I also employ two additional pipes 50 and 52 (See FIG. 2), which may be identical to the hollow pipe 36, but which should preferably be identical to it at least in outward appearance for esthetic purposes. The pipes 36, 50 and 52 are disposed equidistantly around an imaginary circle on the base 11 which is concentric with the longitudinal axis of the tube 15 and, preferably, extend vertically upwardly through outwardly opening notches 54 in the plates 20. The notches 54 are frictionally tight fitting on the pipes 36, 50 and 52 so that, in my preferred example of the invention, there is no need to glue the plates 20 to the tube 12 nor is there any need to use circular collars glued to the tube as supports under the plates. By means of such arrangement, the pipes 36, 50 and 52 provide added stability to the elongate structure of the display case 10 which I have found to be somewhat rickety, tiltable and, in general, unstable when used in the prior art form without such stabilizing pipes. Of course, any reasonable number of such pipes could be similarly disposed on the base 11 around the tube 15 and plates 20 in addition to the pipe 36 as desired, only one of which need be employed for placement of the air line 40 therein. To conceal the loop 46 at the otherwise open upper end of the pipe 36, I place a cap 56 thereover which rests against an upper surface of the upper most one of the plates 20 around the corresponding notch 54. Similarly, for esthetic purposes and balanced appearance, I place the same type of cap 56 on the upper end of the remaining pipes 50 and 52. Lastly, in FIG. 1*a*, it will be seen that I place holes 60 in and around the plates 20 through which test tube like containers 62 can be inserted so as to be suspended by the shoulders of their caps 64. These test tube like containers contain liquid candy such as sour candy and the like which is currently popular with children in this country.

Although the present invention has been described with respect to specific details of a certain preferred embodiment thereof, it is not intended that such details limit the scope and coverage of this patent other than as specifically set forth in the following claims.

I claim:

1. In combination with an article display case of the type which conventionally includes a base; a series of vertically spaced apart article support plates disposed in registry over said base; an elongated, transparent, hollow, liquid containing tube extending vertically upwardly from said base through said plates; and an air pump mounted on said base containing an air outlet port for connection to a base portion of said tube to pump air into a liquid contained in said tube to form air bubbles therein, an upper end of said tube communicating with atmosphere to disperse said bubbles from said liquid; an arrangement for protecting said air pump from damage due to a backup of said liquid into said pump when said pump is inactive comprising an elongated hollow pipe disposed on one end thereof on said base and extending vertically upwardly parallel to and spaced apart from said tube beside said plates, and an air line connected on one end to said air outlet port and extending into a hollow shaft in a lower end portion of said pipe, thence upwardly in said shaft to a level above the surface of said liquid in said tube, thence back downwardly in said shaft to a base portion of said pipe, thence out of said pipe to an air inlet port on a base portion of said tube which communicates with said liquid.

2. In combination with a multi-tier article display case of the type which includes a base; an electric lamp mounted on said base and disposed so as to project a beam of collimated light vertically upwardly; an elongated, transparent, hollow tube having a lower end mounted over said lamp and extending vertically upwardly; a plurality of flat plates for supporting articles for display thereon, said plates being mounted in vertically spaced apart relationship on said hollow tube, said tube containing a liquid extending upwardly in a column through said plates to a level near an upper end thereof; and an air pump mounted on said base next to said lamp and tube and having an air outlet port for connection to a base of said tube to form air bubbles in said liquid, an upper end of said tube communicating with ambient atmosphere to permit said air bubbles to escape from said liquid; an arrangement for protecting said air pump from damage caused by a backup of said liquid into said pump when said pump is inactive comprising an elongated hollow pipe disposed on one end thereof on said base and extending vertically upwardly beside said tube and plates, and and air line connected on one end to the air outlet port of said pump and extending into a hollow shaft in said pipe on a lower end portion thereof, thence upwardly through said shaft to a level above the level of the liquid in said tube, thence through a loop and back downwardly through said shaft and out through a lower end portion of said pipe to a connection on a lower end portion of said tube such that said air outlet port communicates with said liquid in said tube to form bubbles in said liquid when said pump is active.

3. A multi-tier article display comprising a base;

a series of elongated, vertically extending pipes mounted on said base, at least one of said pipes containing a hollow, longitudinally extending shaft, said pipes being equally rotationally spaced apart on an imaginary circle extending around said base;

a plurality of vertically spaced apart plates having broad surfaces disposed horizontally, each of said plates containing a central opening therethrough and being attached to said pipes to form a multi-tier deck of said plates for supporting articles to be displayed thereon;

an electric lamp mounted on said base at the center of the imaginary circle on which said pipes are disposed so as to shine vertically upwardly;

an elongated, transparent, hollow tube mounted on said lamp and extending vertically through the central opening of each of said plates, said tube being filled with a liquid;

an air pump mounted on said base next to said lamp and tube, said pump having an air outlet port; and an air outlet tube being connected on an end thereof to said pump outlet port and extending into a hollow shaft of one of said pipes, thence vertically upwardly through said shaft to and around a loop on an upper end portion of said outlet tube above a surface level of the liquid in said transparent tube, thence downwardly through said shaft and out of said one of said pipes into a base portion of said tube above said lamp.

4. The display case of claim 1 further comprising a cover removably disposed on and over said base for covering said pump and a base portion of said tube, said lower end portion and said base portion of said pipe being under said cover such that portions of said air line which extend into and out of said pipe to and from said pump and said tube are concealed by said cover.

5. The display case of claim 1 further comprising a plurality of pipes, said hollow pipe being one of said plurality of pipes, said pipes being disposed on lower ends thereof on and spaced apart equidistantly around an imaginary circle on said base which is concentric with a longitudinal axis of said tube, said pipes extending vertically upwardly from said base through outer edge portions of said plates to stabilize said tube and said plates on and over said base, respectively.

6. The display case of claim 1 further comprising a cap removably disposed over an upper end of said hollow pipe above an uppermost one of said plates to conceal a loop in said air line at the upper end of said hollow pipe.

7. The display case of claim 1 wherein at least one of said article support plates contains an array of spaced apart openings therein for containing a like array of test tube like containers suspended below said one of said plates by a cap fitted on the upper end of said containers.

8. The display case of claim 5 wherein each of said pipes is identical in outward appearance to the remainder of said pipes, each of said pipes having a cap removably disposed over an upper end thereof above an upper one of said plates.

9. The display case of claim 5 wherein said plurality is three.

10. The display case of claim 5 wherein each of said pipes extends through a separate opening in said cover.

11. The display case of claim 5 wherein each of said pipes extends through a separate outwardly opening notch in each of said plates.

12. The display case of claim 5 wherein each of said plates is comprises a relatively flat circular disc defining a central circular opening and a plurality of radially outwardly opening notches spaced equidistantly from one another around an outer peripheral edge portion, said plurality of outwardly opening notches being equal to said plurality of pipes, the notches in each of said plates being in vertical registry with the notches in the remainder of said plates and containing said pipes.

* * * * *